US006801104B2

(12) United States Patent
Zhu et al.

(10) Patent No.: US 6,801,104 B2
(45) Date of Patent: Oct. 5, 2004

(54) ELECTRONICALLY TUNABLE COMBLINE FILTERS TUNED BY TUNABLE DIELECTRIC CAPACITORS

(75) Inventors: Yongfei Zhu, Columbia, MD (US); Yu Rong, Germantown, MD (US); Kenneth Hersey, Clarksville, MD (US); Khosro Shamsaifar, Ellicott City, MD (US); Ernest Ekelman, Damascus, MD (US); Louise Sengupta, Ellicott City, MD (US)

(73) Assignee: Paratek Microwave, Inc., Columbia, MD (US)

( * ) Notice: Subject to any disclaimer, the term of this patent is extended or adjusted under 35 U.S.C. 154(b) by 0 days.

(21) Appl. No.: 09/932,749

(22) Filed: Aug. 17, 2001

(65) Prior Publication Data

US 2003/0210109 A1 Nov. 13, 2003

Related U.S. Application Data

(60) Provisional application No. 60/227,438, filed on Aug. 22, 2000.

(51) Int. Cl.[7] ..... H01P 1/20; H01P 1/205

(52) U.S. Cl. ..... 333/202; 333/207; 333/235; 333/223; 333/231

(58) Field of Search ..... 333/202, 205, 333/206, 207, 208, 209, 235, 223, 231

(56) References Cited

U.S. PATENT DOCUMENTS

| | | | | |
|---|---|---|---|---|
| 4,093,928 A | | 6/1978 | Proctor | |
| 4,100,504 A | * | 7/1978 | McGann | 333/207 |
| 4,268,809 A | * | 5/1981 | Makimoto et al. | 333/202 |
| 4,323,855 A | | 4/1982 | Gerlach | |
| 4,420,839 A | | 12/1983 | Hogerheiden, Jr. | |
| 4,459,571 A | | 7/1984 | Fraser | |
| 4,477,786 A | * | 10/1984 | Tamura et al. | 333/206 |
| 4,489,293 A | | 12/1984 | Fiedziuszko | |
| 4,502,029 A | | 2/1985 | Reed | |
| 4,568,895 A | | 2/1986 | Reed | |
| 4,578,652 A | | 3/1986 | Sterns | |
| 4,714,906 A | | 12/1987 | D'Albaret et al. | |
| 4,721,932 A | * | 1/1988 | West | 333/202 |
| 4,749,969 A | | 6/1988 | Boire et al. | |
| 4,800,347 A | | 1/1989 | Yorita et al. | |
| 4,800,348 A | | 1/1989 | Rosar et al. | |
| 4,835,499 A | | 5/1989 | Pickett | |
| 5,055,808 A | | 10/1991 | Walker et al. | |
| 5,063,365 A | | 11/1991 | Cappucci | |
| 5,065,120 A | | 11/1991 | Munn | |
| 5,115,373 A | | 5/1992 | Takeda | |
| 5,191,305 A | | 3/1993 | Frost et al. | |

(List continued on next page.)

FOREIGN PATENT DOCUMENTS

| | | |
|---|---|---|
| FR | 2789533 A | 8/2000 |
| WO | WO 9800881 A | 1/1998 |

OTHER PUBLICATIONS

U.S. Application No. 09/419,126.
U.S. Application No. 09/594,837.
U.S. Application No. 09/834,327.
U.S. Application No. 09/882,605.
U.S. Application No. 60/295,046.

*Primary Examiner*—Benny Lee
*Assistant Examiner*—Kimberly Glenn
(74) *Attorney, Agent, or Firm*—Robert P. Lenart; James S. Finn

(57) ABSTRACT

A voltage-controlled tunable filter includes at least two cavity resonators electrically coupled to each other. A voltage tunable dielectric capacitor is positioned within each of the resonators. Connections are provided for applying a control voltage to the voltage tunable dielectric capacitors. An input is coupled to the one of the resonators, and an output is coupled to the other resonator.

8 Claims, 5 Drawing Sheets

U.S. PATENT DOCUMENTS 5,406,234 A 4/1995 Willems
5,412,354 A 5/1995 Quan
5,427,988 A 6/1995 Sengupta et al.
5,459,123 A 10/1995 Das
5,495,215 A 2/1996 Newell et al.
5,635,433 A 6/1997 Sengupta
5,635,434 A 6/1997 Sengupta
5,640,042 A 6/1997 Koscica et al.
5,691,677 A 11/1997 De Maron et al.
5,693,429 A 12/1997 Sengupta et al.
5,721,194 A 2/1998 Yandrofski et al.
5,731,751 A 3/1998 Vangala
5,766,697 A 6/1998 Sengupta et al.
5,798,676 A 8/1998 Jachowski
5,805,033 A 9/1998 Liang et al.
5,818,314 A 10/1998 Baker
5,830,591 A 11/1998 Sengupta et al.
5,846,893 A 12/1998 Sengupta et al.
5,847,620 A 12/1998 Wong et al.
5,900,390 A 5/1999 Das
5,912,798 A 6/1999 Chu
5,949,309 A 9/1999 Correa
5,949,311 A 9/1999 Weiss et al.
5,965,494 A 10/1999 Terashima et al.
5,969,584 A 10/1999 Huang et al.
5,990,766 A 11/1999 Zhang et al.
6,054,908 A * 4/2000 Jackson ..... 333/205
6,074,971 A 6/2000 Chiu et al.
6,097,263 A 8/2000 Mueller et al.
6,111,482 A 8/2000 Atokawa
6,125,027 A * 9/2000 Klee et al. ..... 361/320
6,255,917 B1 7/2001 Scott
6,262,639 B1 7/2001 Shu et al.

* cited by examiner

ELECTRONICALLY TUNABLE COMBLINE FILTERS TUNED BY TUNABLE DIELECTRIC CAPACITORS

CROSS REFERENCE TO RELATED APPLICATION

This application claims the benefit of U.S. Provisional Application No. 60/227,438, filed Aug. 22, 2000.

FIELD OF INVENTION

The present invention generally relates to electronic filters, and more particularly, to tunable filters.

BACKGROUND OF INVENTION

Electrically tunable filters have many uses in microwave and radio frequency systems. Compared to mechanically and magnetically tunable filters, electronically tunable filters have the important advantage of fast tuning capability over wide band application. Because of this advantage, they can be used in the applications such as LMDS (local multipoint distribution service), PCS (personal communication system), frequency hopping, satellite communication, and radar systems.

One electronically tunable filter is the diode varactor-tuned filter. Since a diode varactor is basically a semiconductor diode, diode varactor-tuned filters can be used in monolithic microwave integrated circuits (MMIC) or microwave integrated circuits. The performance of varactors is defined by the capacitance ratio, $C_{max}/C_{min}$, frequency range, and figure of merit, or Q factor at the specified frequency range. The Q factors for semiconductor varactors for frequencies up to 2 GHz are usually very good. However, at frequencies above 2 GHz, the Q factors of these varactors degrade rapidly.

Since the Q factor of semiconductor diode varactors is low at high frequencies (for example, <20 at 20 GHz), the insertion loss of diode varactor-tuned filters is very high, especially at high frequencies (>5 GHz). Another problem associated with diode varactor-tuned filters is their low power handling capability. Since diode varactors are non-linear devices, larger signals generate harmonics and sub-harmonics.

Varactors that utilize a thin film ferroelectric ceramic as a voltage tunable element in combination with a superconducting element have been described. For example, U.S. Pat. No. 5,640,042 discloses a thin film ferroelectric varactor having a carrier substrate layer, a high temperature superconducting layer deposited on the substrate, a thin film dielectric deposited on the metallic layer, and a plurality of metallic conductive means disposed on the thin film dielectric, which are placed in electrical contact with RF transmission lines in tuning devices. Another tunable capacitor using a ferroelectric element in combination with a superconducting element is disclosed in U.S. Pat. No. 5,721,194.

Commonly owned U.S. patent application Ser. No. 09/419,219, filed Oct. 15, 1999, and titled "Voltage Tunable Varactors And Tunable Devices Including Such Varactors", discloses voltage tunable dielectric varactors that operate at room temperature and various devices that include such varactors, and is hereby incorporated by reference.

Combline filters, using resonant cavities, are attractive for use in electronic devices because of their merits such as smaller size, wider spurious free performance compared to the standard waveguide based cavity filters.

There is a need for tunable filters that can operate at radio and microwave frequencies with reduced intermodulation products and at temperatures above those necessary for superconduction.

SUMMARY OF THE INVENTION

Voltage-controlled tunable filters constructed in accordance with this invention include first and second cavity resonators, means for exchanging a signal between the first and second resonators, a first voltage tunable dielectric capacitor positioned within the first resonator, means for applying a control voltage to the first voltage tunable dielectric capacitor, a second voltage tunable dielectric capacitor positioned within the second resonator, means for applying a control voltage to the second voltage tunable dielectric capacitor, an input coupled to the first coaxial resonator, and an output coupled to the first coaxial resonator.

In a first embodiment of the invention, each of the first and second voltage tunable dielectric capacitors includes a first electrode, a tunable dielectric film positioned on the first electrode, and a second electrode positioned on a surface of the tunable dielectric film opposite the first electrode.

In another embodiment, each of the first and second voltage tunable dielectric capacitors includes a substrate, a tunable dielectric film positioned on the substrate, and an electrode positioned on a surface of the tunable dielectric film opposite the substrate. The electrode can be divided into first and second electrodes, separated to form a gap.

An insulating material can be included for insulating the first and second electrodes from the resonator. The tunable dielectric film can comprise barium strontium titanate or a composite of barium strontium titanate.

The voltage-controlled tunable filter can further comprise a first rod positioned in the first resonator, wherein the first voltage tunable dielectric capacitor is positioned at one end of the first rod, and a second rod positioned in the second resonator, wherein the second voltage tunable dielectric capacitor is positioned at one end of the second rod. Each of the rods in the coaxial resonators can be serially connected with one of the voltage tunable dielectric capacitors, and a second end of each of the rods can be connected to ground.

DETAILED DESCRIPTION OF THE INVENTION

Figure 1:
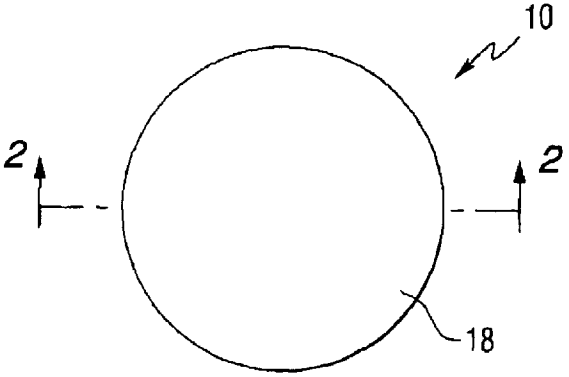
FIG. 1 is a top plan view of a voltage controlled tunable dielectric capacitor that can be used in the filters of this invention.
Figure 2:
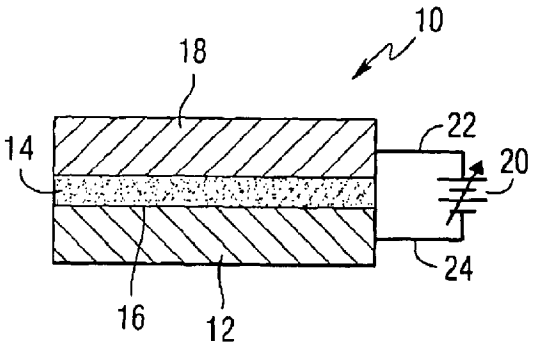
FIG. 2 is a cross sectional view of the capacitor of FIG. 1 taken along line 2—2.

Referring to the drawings, FIG. 1 is a top plan view of a voltage controlled tunable dielectric capacitor 10 that can be used in the filters of this invention. FIG. 2 is a cross sectional view of the capacitor 10 of FIG. 1 taken along line 2—2. The capacitor includes a first electrode 12, a layer, or film, of tunable dielectric material 14 positioned on a surface 16 of the first electrode, and a second electrode 18 positioned on a side of the tunable dielectric material 14 opposite from the first electrode. The first and second electrodes are preferably metal films or plates. An external voltage source 20 is used to apply a tuning voltage to the electrodes, via lines 22 and 24. This subjects the tunable material between the first and second electrodes to an electric field. This electric field is used to control the dielectric constant of the tunable dielectric material. Thus the capacitance of the tunable dielectric capacitor can be changed.

Figure 3:
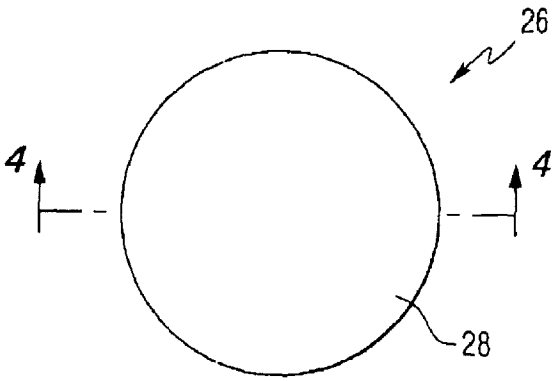
FIG. 3 is a top plan view of another voltage controlled tunable dielectric capacitor that can be used in the filters of this invention.
Figure 4:
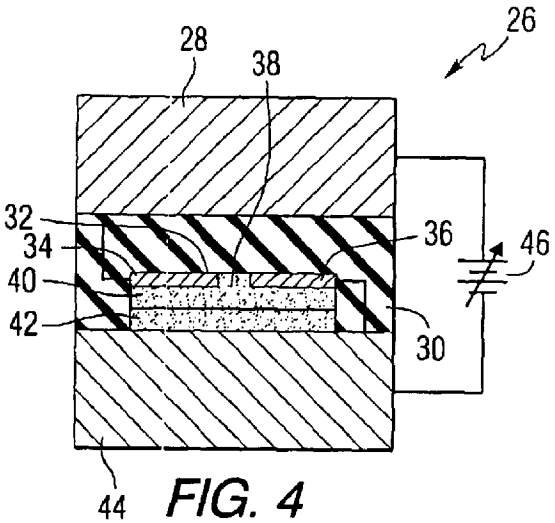
FIG. 4 is a cross sectional view of the capacitor of FIG. 3 taken along line 4—4.

FIG. 3 is a top plan view of another voltage controlled tunable dielectric capacitor 26 that can be used in the filters of this invention. FIG. 4 is a cross sectional view of the capacitor of FIG. 3 taken along line 4—4. The tunable dielectric capacitor of FIGS. 3 and 4 includes a top conductive plate 28, a low loss insulating material 30, a bias metal film 32 forming two electrodes 34 and 36 separated by a gap 38, a layer of tunable material 40, a low loss substrate 42, and a bottom conductive plate 44. The substrate 42 can be, for example, MgO, $LaAlO_3$, alumina, sapphire or other materials. The insulating material can be, for example, silicon oxide or a benzocyclobutene-based polymer dielectrics. An external voltage source 46 is used to apply voltage to the tunable material between the first and second electrodes to control the dielectric constant of the tunable material.

Figure 5:
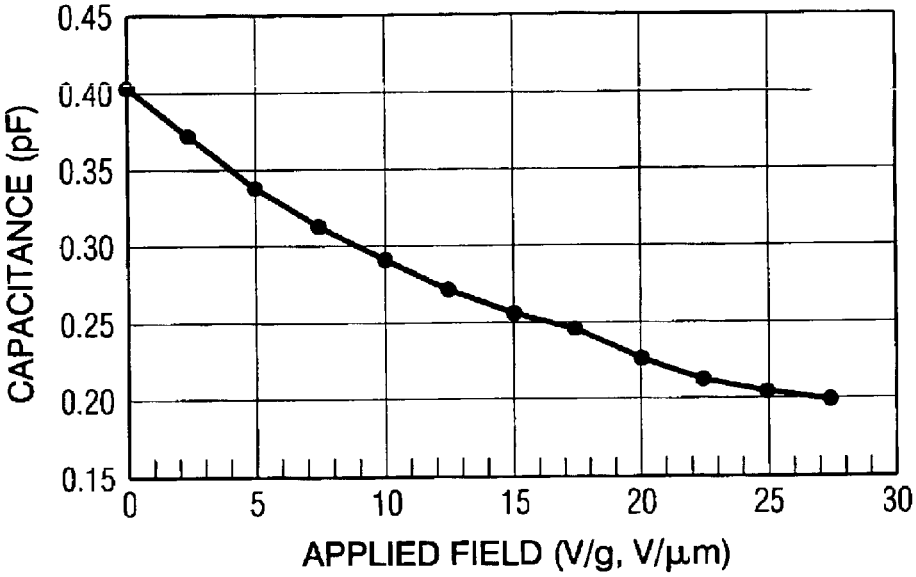
FIG. 5 is a graph of the capacitance versus voltage of a voltage controlled tunable dielectric capacitor that can be used in the filters of this invention.

The tunable dielectric film of the capacitors shown in FIGS. 1*a* and 2*a*, is typical Barium-strontium titanate, $Ba_xSr_{1-x}TiO_3$ (BSTO) where $0<x<1$, BSTO-oxide composite, or other voltage tunable materials. Between electrodes 34 and 36, the gap 38 has a width g, known as the gap distance. This distance g must be optimized to have higher $C_{max}/C_{min}$ in order to reduce bias voltage, and increase the Q of the tunable dielectric capacitor. The typical g value is about 10 to 30 $\mu$m. The thickness of the tunable dielectric layer affects the ratio $C_{max}/C_{min}$ and Q. For tunable dielectric capacitors, parameters of the structure can be chosen to have a desired trade off among Q, capacitance ratio, and zero bias capacitance of the tunable dielectric capacitor. It should be noted that other key effect on the property of the tunable dielectric capacitor is the tunable dielectric film. The typical Q factor of the tunable dielectric capacitor is about 200 to 500 at 1 GHz, and 50 to 100 at 20 to 30 GHz. The $C_{max}/C_{min}$ ratio is about 2, which is independent of frequency. A typical variation in capacitance with applied voltage of the tunable dielectric capacitor at 2 GHz with a gap of 20 $\mu$m at a temperature of 300° K, is shown in FIG. 5.

Figure 6:
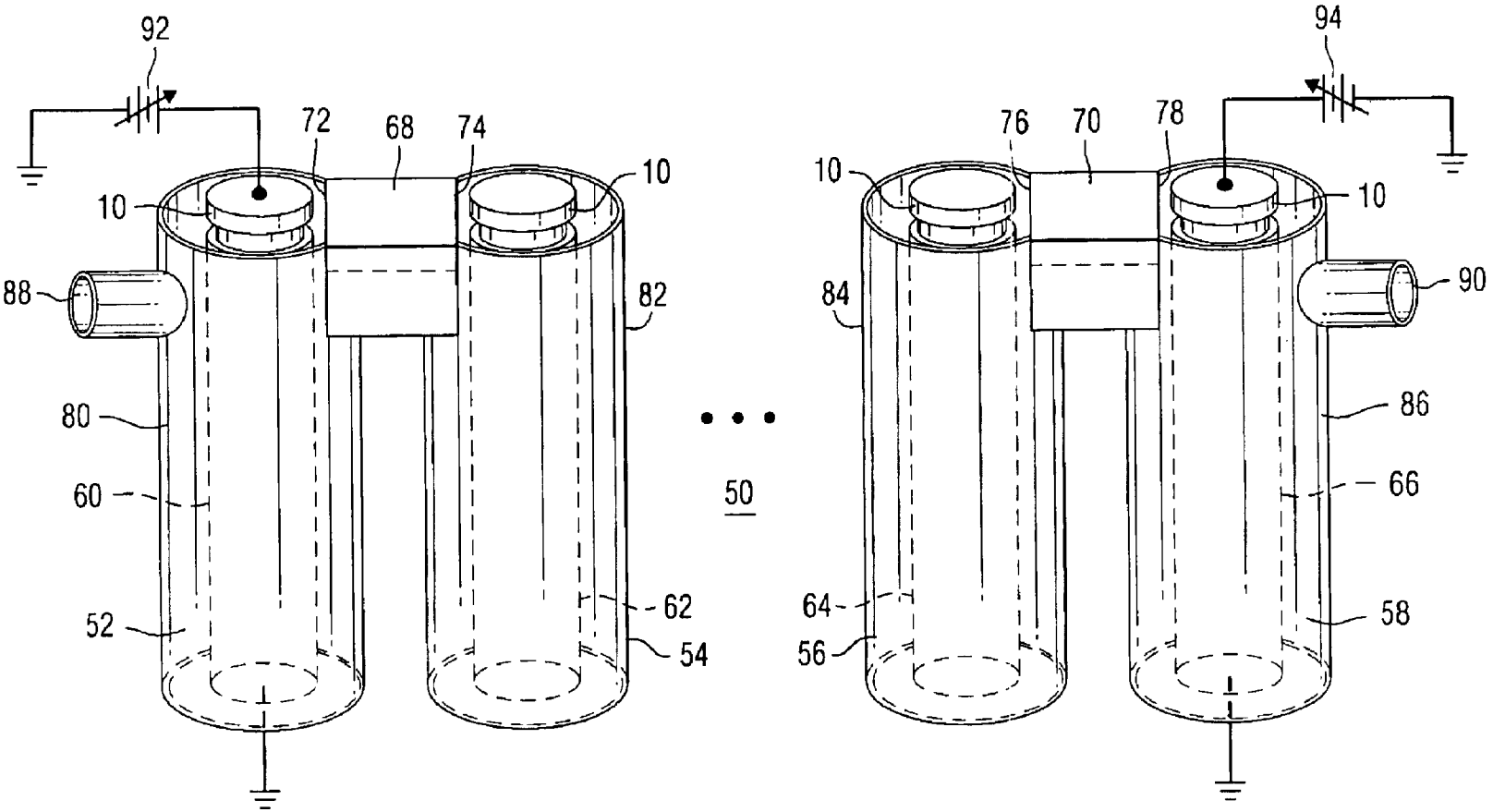
FIG. 6 is a pictorial representation of a filter constructed in accordance with this invention.

FIG. 6 is a pictorial representation of a filter 50 constructed in accordance with this invention. The filter includes a plurality of cylindrical coaxial cavity resonators 52, 54, 56 and 58. A rod 60 is positioned along the axis of resonator 52. Additional rods 62, 64 and 66 are positioned along the axes of resonators 54, 56 and 58. A voltage tunable capacitor, as illustrated in FIGS. 1 and 2 or 3 and 4, is positioned adjacent to one end of each of the rods. The resonators are electrically coupled in series with each other using, for example, channels 68 and 70 connected between openings 72, 74 and 76, 78 in the walls 80, 82, 84 and 86 of the resonators. An input 88, in the form of a probe, is connected to resonator 52. An output 90, in the form of a probe, is connected to resonator 58. One or more external voltage sources, for example 92 and 94, are connected to the tunable capacitors 10 at the ends of the rods to control the capacitance of the tunable capacitors. The rods, and the entire cavity resonator, can be made of metal, but other materials such as plastic, provided they are plated with good conductor, could be used. The tunable capacitors can be positioned anywhere in the vicinity of the rod, as long as they perturb the electromagnetic fields surrounding it.

Figure 7:
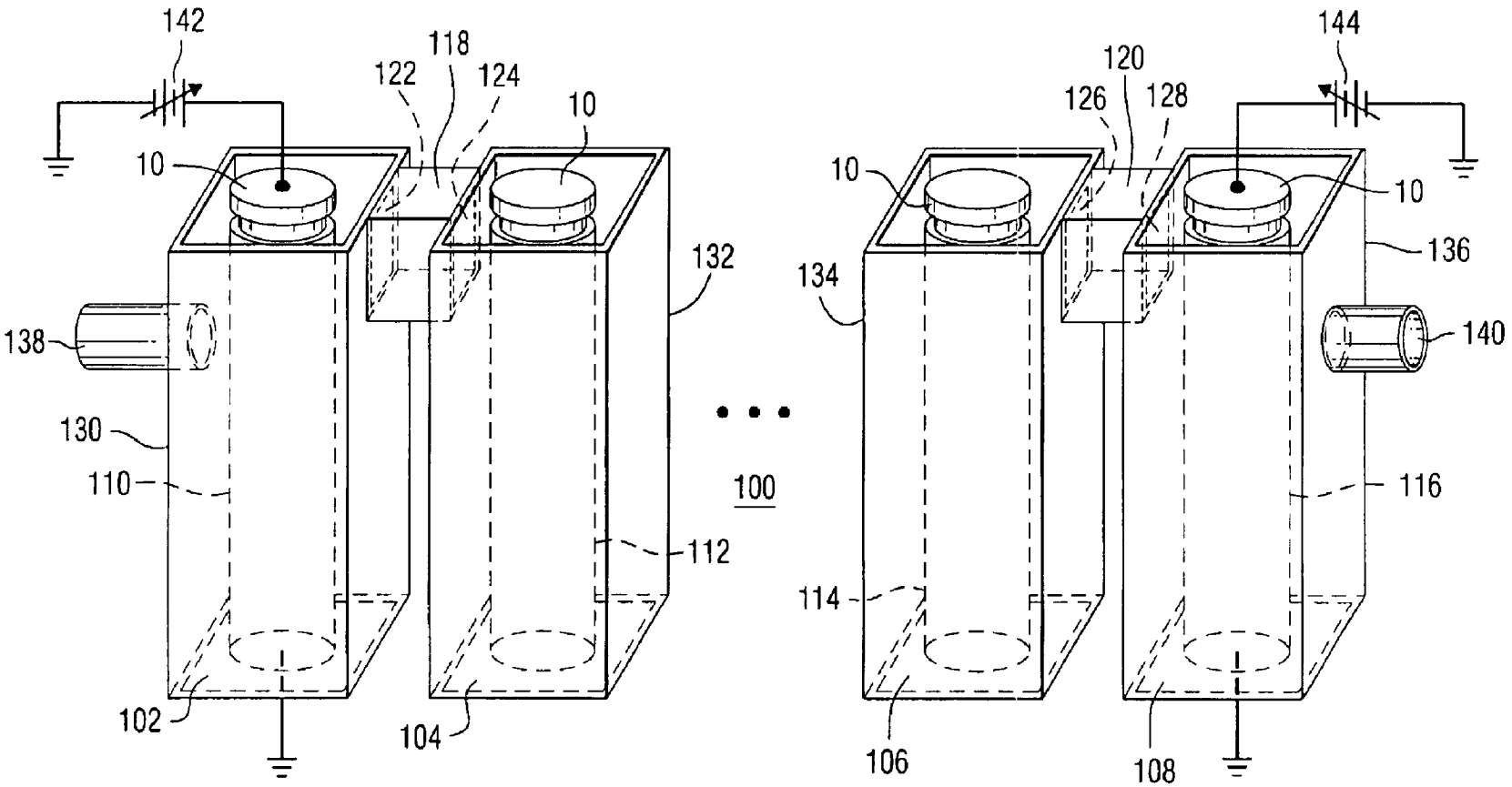
FIG. 7 is a pictorial representation of another filter constructed in accordance with this invention.

FIG. 7 is a pictorial representation of another filter 100 constructed in accordance with this invention. The filter includes a plurality of rectangular cavity resonators 102, 104, 106 and 108. A rod 110 is positioned along the axis of resonator 102. Additional rods 112, 114 and 116 are positioned along the axes of resonators 104, 106 and 108. A voltage tunable capacitor, as illustrated in FIGS. 1 and 2 or 3 and 4, is positioned adjacent to one end of each of the rods. The resonators are electrically coupled in series with each other using, for example, channels 118 and 120 connected between openings 122, 124 and 126, 128 in the walls 130, 132, 134 and 136 of the resonators. An input 138, in the form of a probe, is connected to resonator 102. An output 140, in the form of a probe, is connected to resonator 108. One or more external voltage sources, for example 142 and 144, would be connected to the tunable capacitors at the ends of the rods to control the capacitance of the capacitors.

General configurations of electronically tunable microwave coaxial combline filters tuned by the tunable dielectric capacitor are shown in FIGS. 6 and 7. FIG. 6 shows the cylindrical coaxial combline resonator based electronically tunable filter. FIG. 7 shows the rectangular coaxial combline resonator based electronically tunable filter. Computer simulated performance characteristics for the filters of FIGS. 6 and 7 are presented in FIGS. 8 and 9. By employing the presented filter topologies, for example, a 4-pole filter with the bandwidth 50 MHz at 2.2 GHz can be tuned from the initial state (zero bias) centered at 2.0 GHz to the final state (full bias) centered at 2.4 GHz with the assumption that the tunable dielectric capacitor have a capacitance ratio of 2.

Figure 8:
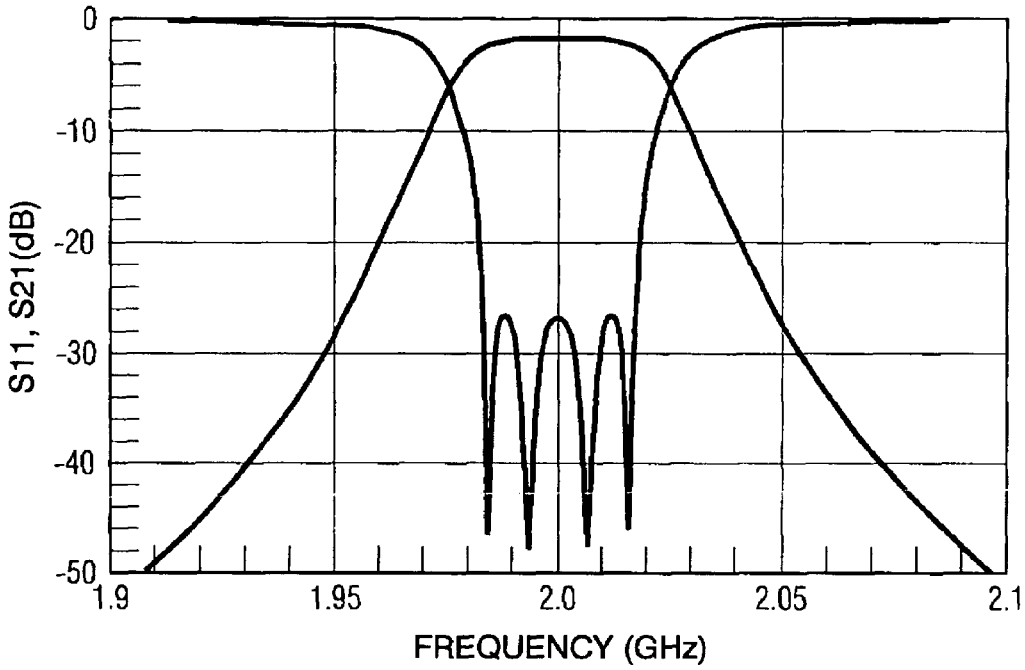
FIG. 8 is a graph of the frequency response of an electronically tunable combline filter constructed in accordance with this invention, with the unloaded Q of 300 under zero bias.
Figure 9:
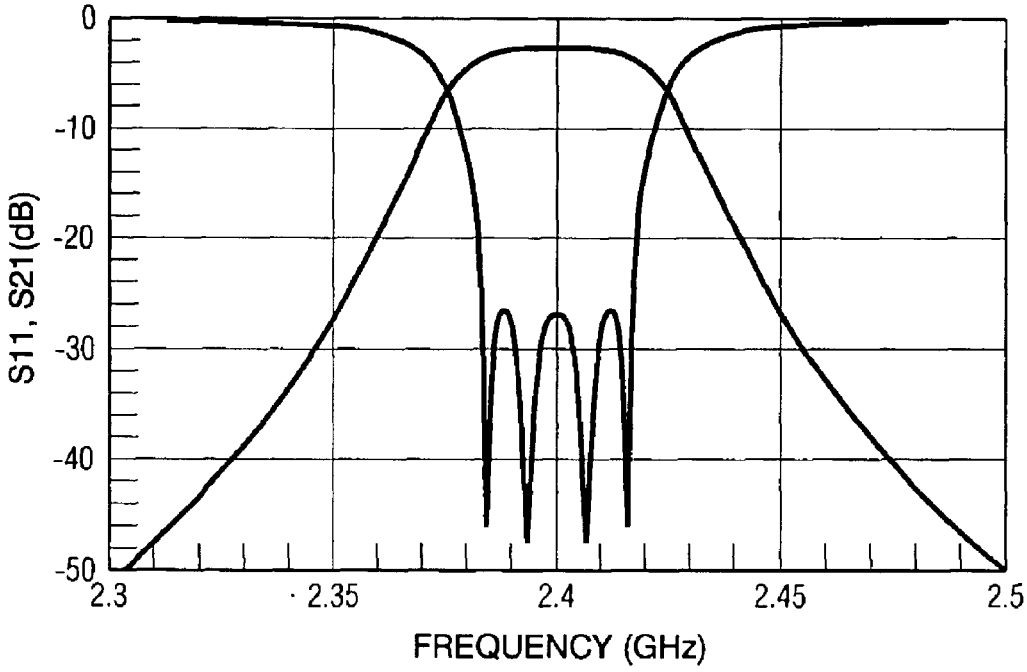
FIG. 9 is a graph of the frequency response of an electronically tunable combline filter constructed in accordance with this invention, with the unloaded Q of 250 under full bias.

FIG. 8 shows a computer-simulated frequency response of the tunable filter with zero-biased tunable dielectric capacitors. The capacitance of the tunable dielectric capacitors was assumed to be 1.0 pF at zero bias. The center frequency of the filter is 2 GHz, and the equal ripple bandwidth is 50 MHz. FIG. 9 is a simulated frequency response of the tunable filter under the full bias, where the capacitance of the tunable dielectric capacitor was assumed to be 0.5 pF. The center frequency of the filter can be tuned up to 2.4 GHz. The bandwidth of the filter under full bias voltage can be kept unchanged compared to that under zero bias. For the filter in FIG. 6, it is assumed that total unloaded Q of the combline resonators plus the tuning element is equal to 300, which is equivalent to 2.8 dB losses. For the filter in FIG. 7, it is assumed that total unloaded Q of combline resonators plus the tuning element is equal to 250, which corresponds to 4.0 dB insertion loss. The loss of the filter based on the three-dimensional structures is smaller than that based on the planar structure with similar characteristics.

The filters of the present invention have low insertion loss, fast tuning speed, high power-handling capability, high IP3 and low cost in the microwave frequency range. Compared to the voltage-controlled semiconductor varactors, voltage-controlled tunable dielectric capacitors have higher Q factors, higher power-handling and higher IP3. Voltage-controlled tunable dielectric capacitors have a capacitance that varies approximately linearly with applied voltage and can achieve a wider range of capacitance values than is possible with semiconductor diode varactors.

The tunable dielectric capacitor in the preferred embodiment of the present invention can include a low loss (Ba, Sr)$TiO_3$-based composite film. The typical Q factor of the tunable dielectric capacitors is 200 to 500 at 2 GHz with capacitance ratio ($C_{max}/C_{min}$) around 2. A wide range of capacitance of the tunable dielectric capacitors is variable, say 0.1 pF to 10 pF. The tuning speed of the tunable dielectric capacitor is less than 30 ns. The practical tuning speed is determined by auxiliary bias circuits. The tunable dielectric capacitor is a packaged two-port component, in which tunable dielectric can be voltage-controlled. The tunable film is deposited on a substrate, such as MgO, $LaAlO_3$, sapphire, $Al_2O_3$ and other dielectric substrates. An applied voltage produces an electric field across the tunable dielectric, which produces an overall change in the capacitance of the tunable dielectric capacitor.

The tunable filter in the present invention is a coaxial resonator based combline tunable filter. The resonator is a metallic cavity loaded with an inner rod. The one end of the rod is grounded and the other end is serially connected with a grounded tuning capacitor. Variation of the capacitance of the tunable capacitor affects the electrical length of the coaxial combline resonator, which varies the resonant frequency of the coaxial combline resonator. The openings on the sides of the cavities are used to provide the necessary couplings between the coaxial combline resonators.

Accordingly, the present invention, by utilizing the unique application of high Q tunable dielectric capacitors, provides a high performance microwave electronically tunable filter.

Tunable dielectric materials have been described in several patents. Barium strontium titanate ($BaTiO_3$—$SrTiO_3$), also referred to as BSTO, is used for its high dielectric constant (200–6,000) and large change in dielectric constant with applied voltage (25–75 percent with a field of 2 Volts/micron). Tunable dielectric materials including barium strontium titanate are disclosed in U.S. Pat. No. 5,427,988 by Sengupta, et al. entitled "Ceramic Ferroelectric Composite Material-BSTO-MgO"; U.S. Pat. No. 5,635,434 by Sengupta, et al. entitled "Ceramic Ferroelectric Composite Material-BSTO-Magnesium Based Compound"; U.S. Pat. No. 5,830,591 by Sengupta, et al. entitled "Multilayered Ferroelectric Composite Waveguides"; U.S. Pat. No. 5,846,893 by Sengupta, et al. entitled "Thin Film Ferroelectric Composites and Method of Making"; U.S. Pat. No. 5,766,697 by Sengupta, et al. entitled "Method of Making Thin Film Composites"; U.S. Pat. No. 5,693,429 by Sengupta, et al. entitled "Electronically Graded Multilayer Ferroelectric Composites"; U.S. Pat. No. 5,635,433 by Sengupta entitled "Ceramic Ferroelectric Composite Material BSTO-ZnO"; U.S. Pat. No. 6,074,971 by Chiu et al. entitled "Ceramic Ferroelectric Composite Materials with Enhanced Electronic Properties BSTO-Mg Based Compound-Rare Earth Oxide". These patents are incorporated herein by reference.

Barium strontium titanate of the formula $Ba_xSr_{1-x}TiO_3$ is a preferred electronically tunable dielectric material due to its favorable tuning characteristics, low Curie temperatures and low microwave loss properties. In the formula $Ba_xSr_{1-x}TiO_3$, x can be any value from 0 to 1, preferably from about 0.15 to about 0.6. More preferably, x is from 0.3 to 0.6.

Other electronically tunable dielectric materials may be used partially or entirely in place of barium strontium titanate. An example is $Ba_xCa_{1-x}TiO_3$, where x is in a range from about 0.2 to about 0.8, preferably from about 0.4 to about 0.6. Additional electronically tunable ferroelectrics include $Pb_xZr_{1-x}TiO_3$ (PZT) where x ranges from about 0.0 to about 1.0, $Pb_xZr_{1-x}SrTiO_3$ where x ranges from about 0.05 to about 0.4, $KTa_xNb_{1-x}O_3$ where x ranges from about 0.0 to about 1.0, lead lanthanum zirconium titanate (PLZT), $PbTiO_3$, $BaCaZrTiO_3$, $NaNO_3$, $KNbO_3$, $LiNbO_3$, $LiTaO_3$, $PbNb_2O_6$, $PbTa_2O_6$, $KSr(NbO_3)$ and $NaBa_2(NbO_3)_5$ $KH_2PO_4$, and mixtures and compositions thereof. Also, these materials can be combined with low loss dielectric materials, such as magnesium oxide (MgO), aluminum oxide ($Al_2O_3$), and zirconium oxide ($ZrO_2$), and/or with additional doping elements, such as manganese (MN), iron (Fe), and tungsten (W), or with other alkali earth metal oxides (i.e. calcium oxide, etc.), transition metal oxides, silicates, niobates, tantalates, aluminates, zirconnates, and titanates to further reduce the dielectric loss.

In addition, the following U.S. patent applications, assigned to the assignee of this application, disclose additional examples of tunable dielectric materials: U.S. application Ser. No. 09/594,837 filed Jun. 15, 2000, entitled "Electronically Tunable Ceramic Materials Including Tunable Dielectric and Metal Silicate Phases"; U.S. application Ser. No. 09/768,690 filed Jan. 24, 2001, entitled "Electronically Tunable, Low-Loss Ceramic Materials Including a Tunable Dielectric Phase and Multiple Metal Oxide Phases"; U.S. application Ser. No. 09/882,605 filed Jun. 15, 2001, entitled "Electronically Tunable Dielectric Composite Thick Films And Methods Of Making Same"; U.S. application Ser. No. 09/834,327 filed Apr. 13, 2001, entitled "Strain-Relieved Tunable Dielectric Thin Films"; and U.S. Provisional Application Serial No. 60/295,046 filed Jun. 1, 2001 entitled "Tunable Dielectric Compositions Including Low Loss Glass Frits". These patent applications are incorporated herein by reference.

The tunable dielectric materials can also be combined with one or more non-tunable dielectric materials. The non-tunable phase(s) may include MgO, $MgAl_2O_4$, $MgTiO_3$, $Mg_2SiO_4$, $CaSiO_3$, $MgSrZrTiO_6$, $CaTiO_3$, $Al_2O_3$, $SiO_2$ and/or other metal silicates such as $BaSiO_3$ and $SrSiO_3$. The non-tunable dielectric phases may be any combination of the above, e.g., MgO combined with $MgTiO_3$, MgO combined with $MgSrZrTiO_6$, MgO combined with $Mg_2SiO_4$, MgO combined with $Mg_2SiO_4$, $Mg_2SiO_4$ combined with $CaTiO_3$ and the like.

Additional minor additives in amounts of from about 0.1 to about 5 weight percent can be added to the composites to additionally improve the electronic properties of the films. These minor additives include oxides such as zirconnates, tannates, rare earths, niobates and tantalates. For example, the minor additives may include $CaZrO_3$, $BaZrO_3$, $SrZrO_3$, $BaSnO_3$, $CaSnO_3$, $MgSnO_3$, $Bi_2O_3/2SnO_2$, $Nd_2O_3$, $Pr_7O_{11}$, $Yb_2O_3$, $Ho_2O_3$, $La_2O_3$, $MgNb_2O_6$, $SrNb_2O_6$, $BaNb_2O_6$, $MgTa_2O_6$, $BaTa_2O_6$ and $Ta_2O_3$.

Thick films of tunable dielectric composites can comprise $Ba_{1-x}Sr_xTiO_3$, where x is from 0.3 to 0.7 in combination with at least one non-tunable dielectric phase selected from MgO, $MgTiO_3$, $MgZrO_3$, $MgSrZrTiO_6$, $Mg_2SiO_4$, $CaSiO_3$, $MgAl_2O_4$, $CaTiO_3$, $Al_2O_3$, $SiO_2$, $BaSiO_3$ and $SrSiO_3$. These compositions can be BSTO and one of these components or two or more of these components in quantities from 0.25 weight percent to 80 weight percent with BSTO weight ratios of 99.75 weight percent to 20 weight percent.

The electronically tunable materials can also include at least one metal silicate phase. The metal silicates may include metals from Group 2A of the Periodic Table, i.e., Be, Mg, Ca, Sr, Ba and Ra, preferably Mg, Ca, Sr and Ba. Preferred metal silicates include $Mg_2SiO_4$, $CaSiO_3$, $BaSiO_3$ and $SrSiO_3$. In addition to Group 2A metals, the present metal silicates may include metals from Group 1A, i.e., Li, Na, K, Rb, Cs and Fr, preferably Li, Na and K. For example, such metal silicates may include sodium silicates such as $Na_2SiO_3$ and $NaSiO_3$—$5H_2O$, and lithium-containing silicates such as $LiAlSiO_4$, $Li_2SiO_3$ and $Li_4SiO_4$. Metals from Groups 3A, 4A and some transition metals of the Periodic Table may also be suitable constituents of the metal silicate phase. Additional metal silicates may include $Al_2Si_2O_7$, $ZrSiO_4$, $KalSi_3O_8$, $NaAlSi_3O_8$, $CaAl_2Si_2O_8$, $CaMgSi_2O_6$, $BaTiSi_3O_9$ and $Zn_2SiO_4$. The above tunable materials can be tuned at room temperature by controlling an electric field that is applied across the materials.

In addition to the electronically tunable dielectric phase, the electronically tunable materials can include at least two additional metal oxide phases. The additional metal oxides may include metals from Group 2A of the Periodic Table, i.e., Mg, Ca, Sr, Ba, Be and Ra, preferably Mg, Ca, Sr and Ba. The additional metal oxides may also include metals from Group 1A, i.e., Li, Na, K, Rb, Cs and Fr, preferably Li, Na and K. Metals from other Groups of the Periodic Table may also be suitable constituents of the metal oxide phases. For example, refractory metals such as Ti, V, Cr, Mn, Zr, Nb, Mo, Hf, Ta and W may be used. Furthermore, metals such as Al, Si, Sn, Pb and Bi may be used. In addition, the metal oxide phases may comprise rare earth metals such as Sc, Y, La, Ce, Pr, Nd and the like.

The additional metal oxides may include, for example, zirconnates, silicates, titanates, aluminates, stannates, niobates, tantalates and rare earth oxides. Preferred additional metal oxides include $Mg_2SiO_4$, MgO, $CaTiO_3$, $MgZrSrTiO_6$, $MgTiO_3$, $MgAl_2O_4$, $WO_3$, $SnTiO_4$, $ZrTiO_4$, $CaSiO_3$, $CaSnO_3$, $CaWO_4$, $CaZrO_3$, $MgTa_2O_6$, $MgZrO_3$, $MnO_2$, PbO, $Bi_2O_3$ and $La_2O_3$. Particularly preferred additional metal oxides include $Mg_2SiO_4$, MgO, $CaTiO_3$, $MgZrSrTiO_6$, $MgTiO_3$, $MgAl_2O_4$, $MgTa_2O_6$ and $MgZrO_3$.

The additional metal oxide phases are typically present in total amounts of from about 1 to about 80 weight percent of the material, preferably from about 3 to about 65 weight percent, and more preferably from about 5 to about 60 weight percent. In one preferred embodiment, the additional metal oxides comprise from about 10 to about 50 total weight percent of the material. The individual amount of each additional metal oxide may be adjusted to provide the desired properties. Where two additional metal oxides are used, their weight ratios may vary, for example, from about 1:100 to about 100:1, typically from about 1:10 to about 10:1 or from about 1:5 to about 5:1. Although metal oxides in total amounts of from 1 to 80 weight percent are typically used, smaller additive amounts of from 0.01 to 1 weight percent may be used for some applications.

In one embodiment, the additional metal oxide phases may include at least two Mg-containing compounds. In addition to the multiple Mg-containing compounds, the material may optionally include Mg-free compounds, for example, oxides of metals selected from Si, Ca, Zr, Ti, Al and/or rare earths. In another embodiment, the additional metal oxide phases may include a single Mg-containing compound and at least one Mg-free compound, for example, oxides of metals selected from Si, Ca, Zr, Ti, Al and/or rare earths. The high Q tunable dielectric capacitor utilizes low loss tunable substrates or films.

To construct a tunable device, the tunable dielectric material can be deposited onto a low loss substrate. In some instances, such as where thin film devices are used, a buffer layer of tunable material, having the same composition as a main tunable layer, or having a different composition can be inserted between the substrate and the main tunable layer. The low loss dielectric substrate can include magnesium oxide (MgO), aluminum oxide ($Al_2O_3$), and lanthium oxide ($LaAl_2O_3$).

Compared to semiconductor varactor based tunable filters, the tunable dielectric capacitor based tunable filters of this invention have the merits of lower loss, higher power-handling, and higher IP3, especially at higher frequencies (>10 GHz).

The present invention is a tunable combline filter, which is tuned by voltage-controlled tunable dielectric capacitors. The tunable filter includes a plurality of many coupled coaxial combline resonators operating in the microwave frequency range. In the filter structure, the tuning element is a voltage-controlled tunable dielectric capacitor. Since the tunable capacitors show high Q, high IP3 (low intermodulation distortion) and low cost, the tunable filter in the present invention has the advantage of low insertion loss, fast tuning, and high power handling.

While the present invention has been described in terms of its preferred embodiments, it will be apparent to those skilled in the art that various changes can be made to the disclosed embodiments without departing from the scope of the invention as set forth in the following claims.

What is claimed is:

1. A voltage-controlled tunable filter including:

first and second cavity resonators;

means for exchanging a signal between the first and second cavity resonators;

a first voltage tunable dielectric capacitor positioned within the first cavity resonator, said dielectric capacitor including $Ba_xCa_{1-x}TiO_3$, where x is in a range from about 0.2 to about 0.8;

means for applying a control voltage to the first voltage tunable dielectric capacitors;

a second voltage tunable dielectric capacitor positioned within the second cavity resonator;

means for applying a control voltage to the second voltage tunable dielectric capacitors;

an input coupled to the first cavity resonator; and an output coupled to the second cavity resonator.

2. The voltage-controlled tunable filter of claim 1, wherein each of the first and second voltage tunable dielectric capacitors includes:

a first electrode;

a tunable dielectric film positioned on the first electrode; and a second electrode positioned on a surface of the tunable dielectric film opposite the first electrode.

3. The voltage-controlled tunable filter of claim 1, further comprising:

a plurality of additional coaxial resonators, electrically coupled in series to said first and second cavity resonators;

means for exchanging a signal between the additional resonators; and a plurality of additional voltage tunable dielectric capacitors, each of the additional voltage tunable dielectric capacitors being positioned within one of the additional resonators.

4. The voltage-controlled tunable filter of claim 1, further comprising:

a first rod positioned in the first resonator, wherein the first voltage tunable dielectric capacitor is positioned at one end of the first rod; and a second rod positioned in the second resonator, wherein the second voltage tunable dielectric capacitor is positioned at one end of the second rod.

5. The voltage-controlled tunable filter of claim 4, wherein:

each of the rods in the cavity resonators is serially connected with one of the voltage tunable dielectric capacitors.

6. The voltage-controlled tunable filter of claim 4, wherein each of the rods in the cavity resonators is grounded.

7. The voltage-controlled tunable filter of claim 1, wherein the input comprises a first coupling probe and the output comprises a second coupling probe.

8. The voltage-controlled tunable filter of claim 1, wherein each of the first and second voltage tunable dielectric capacitors includes:

a substrate;

a tunable dielectric film positioned on the substrate; and first and second electrodes positioned on a surface of the tunable dielectric film opposite the substrate, the first and second electrodes being separated to form a gap.

* * * * *